US011016424B2

(12) United States Patent
Nakajima

(10) Patent No.: US 11,016,424 B2
(45) Date of Patent: May 25, 2021

(54) IMAGE FORMING APPARATUS AND DEVELOPER CONTAINER

(71) Applicant: TOSHIBA TEC KABUSHIKI KAISHA, Tokyo (JP)

(72) Inventor: Takahiro Nakajima, Kawasaki Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/812,046

(22) Filed: Mar. 6, 2020

(65) Prior Publication Data

US 2020/0379381 A1 Dec. 3, 2020

(30) Foreign Application Priority Data

May 27, 2019 (JP) ..... JP2019-098249

(51) Int. Cl.
*G03G 15/20* (2006.01)
*G03G 15/08* (2006.01)

(52) U.S. Cl.
CPC ..... *G03G 15/2039* (2013.01); *G03G 15/0863* (2013.01)

(58) Field of Classification Search
CPC ..... G03G 9/08797; G03G 15/0121; G03G 15/0863; G03G 15/2039; G03G 21/18
USPC ..... 399/38, 46, 67, 69, 107, 110, 111, 119, 399/120, 252, 258, 262
See application file for complete search history.

(56) References Cited

U.S. PATENT DOCUMENTS 8,781,346 B2 * 7/2014 Odani ..... G03G 15/50 399/44
2008/0181638 A1 7/2008 Fujioka
2016/0131996 A1 5/2016 Kuramashi et al.

FOREIGN PATENT DOCUMENTS

JP 2000356870 A 12/2000
JP 2007148254 A 6/2007
JP 2016166986 A 9/2016

OTHER PUBLICATIONS

Extended European Search Report dated Oct. 9, 2020 in related European Patent Application 20169188.8, 30 pages.

* cited by examiner

*Primary Examiner* — Hoan H Tran
(74) *Attorney, Agent, or Firm* — Kim & Stewart LLP

(57) ABSTRACT

An image forming apparatus of the embodiment has a fixing unit and a temperature controller. The fixing unit performs the fixing process of developer transferred to a sheet by applying heat to the sheet at a predetermined fixing temperature. The temperature controller corrects the fixing temperature in the fixing process based on information indicating the manufacturing time of the developer.

19 Claims, 11 Drawing Sheets

FIG. 4

| ADDRESS | CONTENT |
| --- | --- |
| A001 | IDENTIFICATION INFORMATION |
| A002 | MANUFACTURING DATE |
| A003 | HEAT CHARACTERISTIC VALUE |

FIG. 5

| ADDRESS | CONTENT |
| --- | --- |
| B001 | IDENTIFICATION INFORMATION |
| B002 | MANUFACTURING DATE |
| B003 | HEAT CHARACTERISTIC VALUE |

FIG. 6

| HEAT CHARACTERISTIC CLASS | Tg (℃) | Tm (℃) | FIXING TEMPERATURE CORRECTION VALUE (℃) |
|---|---|---|---|
| 1st THERMAL CHARACTERISTIC CLASS | 30 ~ 34 | 100 ~ 105 | -10 |
| 2nd THERMAL CHARACTERISTIC CLASS | 30 ~ 34 | 106 ~ 109 | -5 |
| 3rd THERMAL CHARACTERISTIC CLASS | 35 ~ 40 | 100 ~ 105 | -5 |
| 4th THERMAL CHARACTERISTIC CLASS | 35 ~ 40 | 106 ~ 109 | 0 |
| 5th THERMAL CHARACTERISTIC CLASS | 35 ~ 40 | 110 ~ 115 | +5 |
| 6th THERMAL CHARACTERISTIC CLASS | 41 ~ 45 | 106 ~ 109 | +5 |
| 7th THERMAL CHARACTERISTIC CLASS | 41 ~ 45 | 110 ~ 115 | +10 |

FIG. 7

| ELAPSED DAYS CLASS | ELAPSED DAYS AFTER MANUFACTURE (unit : days). | FIXING TEMPERATURE CORRECTION VALUE (°C) |
|---|---|---|
| 1st ELAPSED DAYS CLASS | 0 ～ 180 | 0 |
| 2nd ELAPSED DAYS CLASS | 181 ～ 300 | +3 |
| 3rd ELAPSED DAYS CLASS | 301 ～ | +5 |

FIG. 11

| | HEAT CHARAC-TERISTIC CLASS | ELAPSED DAYS | FIXING T CORRECTION | FIXING T CORRECTION VALUE (°C) | 10°C/20wt% OFFSET PRESENCE | 35°C/85wt% OFFSET PRESENCE | DETER-MINATION |
|---|---|---|---|---|---|---|---|
| EXAMPLE 1 | 4th | 1st | ON | 0 | No | No | OK |
| EXAMPLE 2 | 4th | 2nd | ON | +3 | No | No | OK |
| EXAMPLE 3 | 4th | 3rd | ON | +5 | No | No | OK |
| EXAMPLE 4 | 1st | 1st | ON | -10 | No | No | OK |
| EXAMPLE 5 | 2nd | 1st | ON | -5 | No | No | OK |
| EXAMPLE 6 | 3rd | 1st | ON | -5 | No | No | OK |
| EXAMPLE 7 | 5th | 1st | ON | +5 | No | No | OK |
| EXAMPLE 8 | 6th | 1st | ON | +5 | No | No | OK |
| EXAMPLE 9 | 7th | 1st | ON | +10 | No | No | OK |
| EXAMPLE 10 | 1st | 2nd | ON | -7 | No | No | OK |
| EXAMPLE 11 | 1st | 3rd | ON | -5 | No | No | OK |
| EXAMPLE 12 | 7th | 2nd | ON | +13 | No | No | OK |
| EXAMPLE 13 | 7th | 3rd | ON | +15 | No | No | OK |
| COMPARISON 1 | 1st | 1st | OFF | 0 | No | Presence | NG |
| COMPARISON 2 | 1st | 3rd | OFF | 0 | No | Presence | NG |
| COMPARISON 3 | 2nd | 1st | OFF | 0 | No | Presence | NG |
| COMPARISON 4 | 2nd | 3rd | OFF | 0 | Presence | Presence | NG |
| COMPARISON 5 | 3rd | 1st | OFF | 0 | No | Presence | NG |
| COMPARISON 6 | 3rd | 3rd | OFF | 0 | Presence | Presence | NG |
| COMPARISON 7 | 5th | 1st | OFF | 0 | Presence | No | NG |
| COMPARISON 8 | 5th | 3rd | OFF | 0 | Presence | No | NG |
| COMPARISON 9 | 6th | 1st | OFF | 0 | Presence | Presence | NG |
| COMPARISON 10 | 6th | 3rd | OFF | 0 | Presence | Presence | NG |
| COMPARISON 11 | 7th | 1st | OFF | 0 | Presence | No | NG |
| COMPARISON 12 | 7th | 3rd | OFF | 0 | Presence | No | NG |

IMAGE FORMING APPARATUS AND DEVELOPER CONTAINER

CROSS-REFERENCE TO RELATED APPLICATIONS

This application is based upon and claims the benefit of priority from Japanese Patent Application No. 2019-098249, filed on May 27, 2019, the entire contents of which are incorporated herein by reference.

FIELD

Embodiments described herein relate to an image forming apparatus and a developer container.

BACKGROUND

The heat characteristics of the toner may vary, for example, from one lot to another. This variation causes a difference in heat characteristic values, such as, for example, glass transition temperature (Tg) and melting temperature (Tm) of the toner. In the past, there has been a measure for suppressing the occurrence of a fixing offset even if the heat characteristic value of a toner (hereinafter referred to as "upper and lower limit articles") is close to the upper or lower limits of an allowable range. The measures mentioned herein are, for example, optimization of fixing temperature control, optimization of setting conditions of the fixing device, and the like. However, in the case of the upper and lower limits, there is a high possibility that the margin provided by the above measures may be insufficient in comparison with the toner whose heat characteristic value is close to the median value (center product). As a result, a fixing offset occurs in some cases.

In recent years, for the purpose of saving energy in a Multi Function Peripheral (hereinafter referred to as MFP), a low-temperature fixing toner which can be fixed at a temperature lower than that in the past may be used. However, in the low-temperature fixing toner using, for example, a crystalline polyester resin or the like, the value of the glass transition temperature Tg may increase due to aging after the manufacture. As a result, there has been a case where a fixing offset occurs in some cases.

BRIEF DESCRIPTION OF THE DRAWINGS

FIG. 4 is a diagram showing an example arrangement of information in the table in the memory of the image forming apparatus according to the embodiment.

FIG. 5 is a diagram illustrating an arrangement of information in a data table in a memory of a cartridge according to one embodiment.

FIG. 6 is a diagram showing an arrangement of information on the heat characteristic master table in the memory of the image forming apparatus according to one embodiment.

FIG. 7 is a diagram showing an arrangement of the information of the elapsed days master table in the memory of the image forming apparatus according to one embodiment.

FIG. 11 is a diagram showing an evaluation result of the fixing evaluation.

DETAILED DESCRIPTION

According to one embodiment, an image forming apparatus has a fixing unit and a temperature controller. The fixing unit performs the fixing process of developer transferred to a sheet by applying heat to the sheet at a predetermined fixing temperature. The temperature controller is configured to correct the fixing temperature in the fixing process based on information indicating the manufacturing time of the developer.

Hereinafter, an image forming apparatus according to one embodiment will be described with reference to the drawings.

Figure 1:
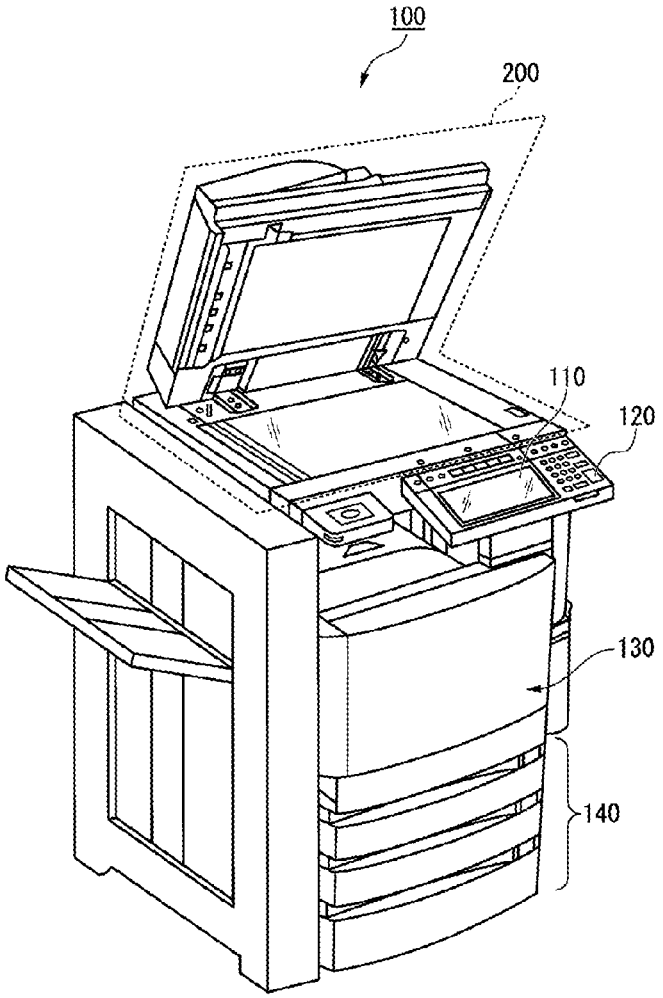
FIG. 1 is an external view showing a configuration of an image forming apparatus according to one embodiment.

FIG. 1 is an external view showing a configuration of an image forming apparatus 100 according to one embodiment. The image forming apparatus 100 is, for example, an MFP. The image forming apparatus 100 includes a display 110, a control panel 120, a printer 130, a sheet storage 140, and an image reading unit 200.

The image forming apparatus 100 forms an image on a sheet using developer such as toner. The sheet may be, for example, paper or label paper. The sheet may be any material as long as the image forming apparatus 100 can form an image on the surface thereof.

The display 110 is an image display device such as a liquid crystal display, an organic EL (Electro Luminescence) display, or the like. The display 110 displays various information regarding the image forming apparatus 100. The various information is, for example, information indicating the number of sheets on which an image is to be formed.

The control panel 120 includes a plurality of buttons. The control panel 120 accepts the operation of the user. The control panel 120 outputs a signal corresponding to the operation performed by the user to the controller of the image forming apparatus 100. Note that the display 110 and control panel 120 may be configured as a single touch panel.

The printer 130 forms an image on the sheet based on the image information generated by the image reading unit 200. The printer 130 may form an image on a sheet based on image information (online data) received via a communication path. The sheet on which the image is formed may be a sheet stored in the sheet storage 140 or a sheet inserted into the image forming apparatus 100.

The sheet storage 140 accommodates a sheet used for image formation in the printer 130. The image reading unit 200 (scanner) reads the image information to be read based on the light and dark of the image to be read. The image reading unit 200 outputs the read image information to the printer 130. The image corresponding to the recorded image information is formed on the sheet by the printer 130. The image reading unit 200 may output the read image information to another information processing apparatus via the network.

Figure 2:
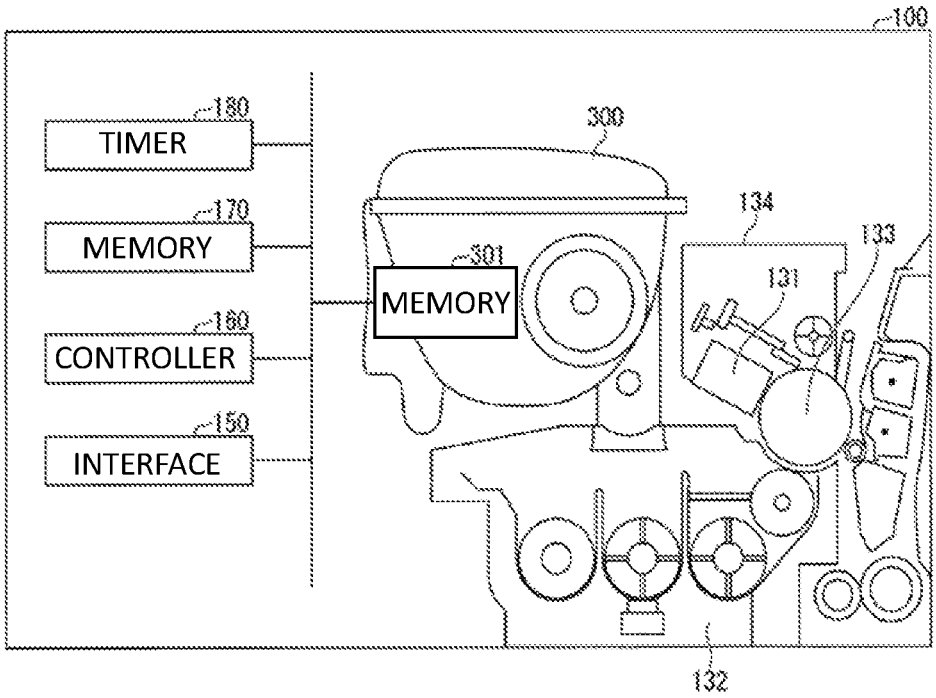
FIG. 2 is a diagram illustrating a configuration of an image forming apparatus according to one embodiment.

FIG. 2 is a diagram illustrating the configuration of the image forming apparatus 100 according to one embodiment. The image forming apparatus 100 comprises a charging device 131, a developing unit 132, an exposure drum 133, and a cleaning device 134 as the printer 130. The image forming apparatus 100 includes an interface 150, a controller 160, a memory 170, and a timer 180.

The charging device 131 forms an electrostatic latent image on exposure drum 133 based on the image information. The developing unit 132 forms a visible image by attaching developer to the electrostatic latent image. Developer is, for example, a toner. The exposure drum 133 transfers the visible image onto the sheet. A fixing unit 50 (FIG. 3) of the printer 130 fixes the transferred visible image onto the sheet by heating and pressurizing the sheet. The cleaning device 134 removes developer that remains untransferred from exposure drum 133.

The image forming apparatus 100 is removably mounted with a cartridge 300 containing developer. The cartridge 300 includes a memory 301. The memory 301 is a nonvolatile storage medium (non-transitory storage medium) such as a flash memory, for example. The memory 301 stores, for example, a data table.

The data table stored in the memory 301 includes, for example, information in which identification information, a manufacture date, and a heat characteristic value are associated with each other. The identification information is identification information (for example, serial number or the like) for identifying the cartridge 300 provided with the memory 301. The manufacture date is a manufacture date of developer contained in the cartridge 300. The heat characteristic value is a heat characteristic value at the time of manufacturing the developer.

The heat characteristic value referred to herein is, for example, a heat characteristic value which changes over time, such as a value of a glass transition temperature (Tg) of a toner and a value of a melting temperature (Tm). Instead of the manufacture date, other information indicating the manufacturing time may be associated, for example, the manufacturing year and month or the manufacturing year. Hereinafter, information (identification information, manufacture date, and heat characteristic value) included in the data table will be referred to as "developer information".

The image forming apparatus 100 includes an interface 150, a controller 160, and a memory 170.

When the cartridge 300 is installed in the image forming apparatus 100, the interface 150 transfers the information stored in the memory 301 included in the cartridge 300 to the controller 160. The interface 150 transfers the developer information stored in the memory 301 to the controller 160, for example, when the front cover of the printer 130 is opened or closed. Alternatively, the interface 150 transfers the developer information stored in the memory 301 to the controller 160 when, for example, the image forming apparatus 100 is turned on.

The controller 160 records the developer information transferred from the interface 150 to the memory 170.

The controller 160 controls the operation of each functional unit of the image forming apparatus 100. A part or all of the controller 160 is realized as software by executing a program stored in the memory 170 by a processor such as a CPU (Central Processing Unit). Some or all of the controller 160 may be implemented using hardware such as LSI (Large Scale Integration), for example.

The memory 170 is a nonvolatile storage medium (non-transitory storage medium) such as a flash memory, for example. The memory 170 stores a program and a data table, for example. The memory 170 may include a volatile storage medium such as a dynamic random access memory (DRAM), for example.

The data table stored in the memory 170 includes, for example, information in which identification information, a manufacture date, and a heat characteristic value are associated with each other. The identification information is identification information (for example, serial number or the like) identifying the cartridge 300. The manufacture date is a manufacture date of developer contained in the cartridge 300. The heat characteristic value is a heat characteristic value at the time of manufacturing the developer.

The memory 170 stores, for example, two master tables in advance. One of the master tables includes, for example, information relating to a heat characteristic of developer and a correction value of a fixing temperature in a fixing process of a developer. Hereinafter, this master table will be referred to as a "heat characteristic master table". Hereinafter, the correction value is referred to as a "fixing temperature correction value".

The other master table includes information in which information about the number of elapsed days from the manufacture date of the developer is associated with the fixing temperature correction value. Hereinafter, this master table will be referred to as an "elapsed days master table".

Also, the memory 170 may store calendar information.

The timer 180 generates current time information (calendar information). When the developer information is acquired, the controller 160 calculates the number of elapsed days from the manufacture date based on the manufacture date and the current time information included in the developer information.

Figure 3:
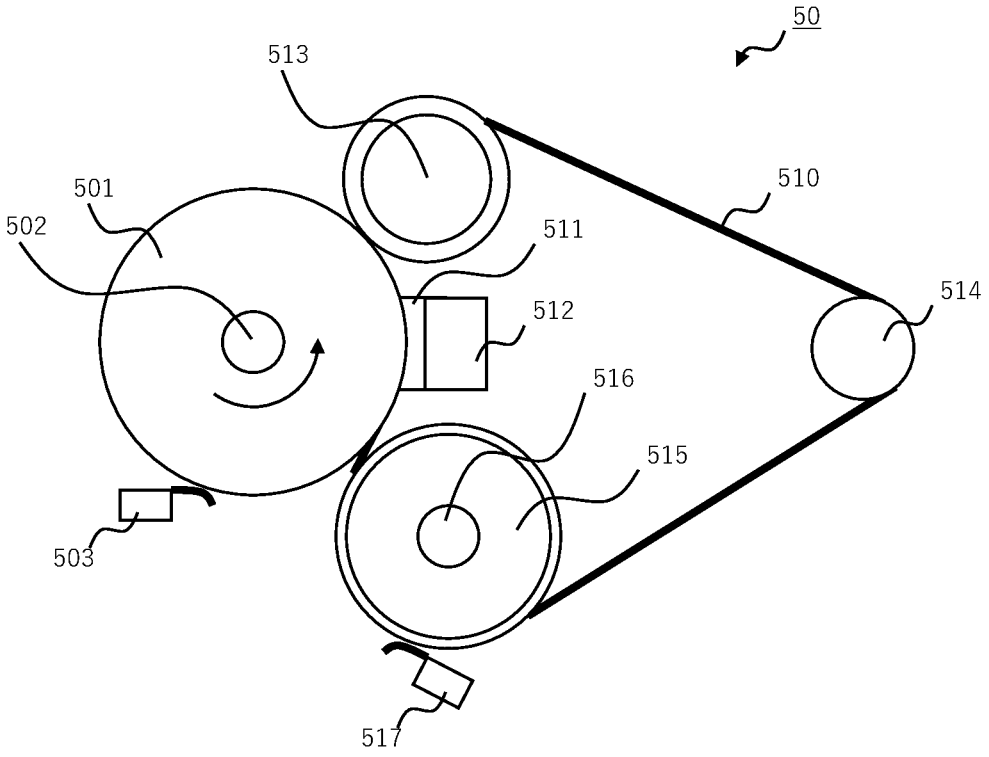
FIG. 3 is a schematic diagram a configuration of a fixing unit included in a printer according to one embodiment.

FIG. 3 is a schematic diagram illustrating an example of the configuration of the fixing unit 50 included in the printer 130 according to one embodiment. The fixing unit 50 includes a heat roller 501, a lamp 502, a thermistor 503, a pressure belt 510, a pressure pad 511, a pad holder 512, a pressure roller 513, a tension roller 514, a belt heat roller 515, a pressure belt lamp 516, and a pressure thermistor 517.

The heat roller 501 is a fixing member formed in a cylindrical shape. The lamp 502 is provided inside the heat roller 501. The lamp 502 heats the heat roller 501 by generating heat. The thermistor 503 measures the surface temperature of the heat roller 501. The diameter of the heat roller 501 is, for example, 45 mm.

The pressure belt 510 is held by the pressure roller 513, the tension roller 514, and the belt heat roller 515. The pressure belt 510 is in pressure contact with the heat roller 501 by the pressure pad 511 and the pressure roller 513. By this pressure contact, a fixing nip portion is formed between the pressure belt 510 and the heat roller 501.

The pressure pad 511 is held in pressure contact with the heat roller 501 via the pressure belt 510. The pressure pad 511 has a width of, for example, 10 mm. The pad holder 512 holds the pressure pad 511 in pressure contact with the heat roller 501.

The pressure roller 513 is disposed downstream of the sheet in the conveying direction. The pressure roller 513 causes the pressure belt 510 to be in pressure contact with the heat roller 501. The pressure roller 513 forms an outlet of the fixing nip portion. The pressure roller 513 has a diameter of, for example, 18 mm.

The tension roller 514 is disposed at a position away from the pressure roller 513 and the belt heat roller 515 to apply tension to the pressure belt 510. The belt heat roller 515 is disposed upstream of the sheet in the conveying direction. The belt heat roller 515 is formed in a hollow cylindrical shape. A pressure belt lamp 516 is provided inside the belt heat roller 515.

The pressure belt lamp 516 heats the belt heat roller 515 by generating heat. The pressure belt lamp 516 is constructed, for example, using a halogen lamp. The pressure thermistor 517 measures the surface temperature of the pressure belt 510 in the vicinity of the belt heat roller 515. The belt heat roller 515 has a diameter of, for example, 20 mm.

FIG. 4 is a diagram showing the arrangement of information in the data table in the memory 170 of the image forming apparatus 100 according to one embodiment. A plurality of addresses (storage areas) are defined in the memory 170. FIG. 4 shows a case where 3 addresses "A001" to "A003" are defined in the memory 170, as an example.

The address "A001" is stored in the memory 301 of the cartridge 300 by transferring the information stored in the address "B001". An identification information identifying the cartridge 300 is stored in the address "A001".

The address "A002" is stored in the memory 301 of the cartridge 300 by transferring the information stored in the address "B002". The manufacture date of developer contained in the cartridge 300 is stored in the address "A002".

The address "A003" is stored in the memory 301 of the cartridge 300 by transferring the information stored in the address "B003". The address "A003" stores heat characteristic value (values of glass transition temperature Tg and melting temperature Tm) at the time of manufacturing developer included in the cartridge 300.

FIG. 5 is a diagram showing the arrangement of information in the data table in the memory 301 of the cartridge 300 according to one embodiment. A plurality of addresses (storage areas) are defined in the memory 301. FIG. 5 shows a case where 3 addresses from "B001" to "B003" are defined in the memory 301 by way of example.

The address "B001" stores identification information for identifying the cartridge 300 having its own memory 301 in advance. The address "B002" stores the manufacture date of the developer contained in the cartridge 300 having its own memory 301 beforehand. The address "B003" stores the heat characteristic value (value of glass transition temperature Tg and value of melting temperature Tm) at the time of manufacturing the developer included in the cartridge 300 having its own memory 301. The heat characteristic value is measured, for example, at the time of manufacture per lot of developer in cartridge 300.

FIG. 6 is a diagram showing the arrangement of information on the heat characteristic master table in the memory 170 of the image forming apparatus 100 according to one embodiment. The heat characteristic master table is a table indicating a heat characteristic class determined in accordance with a heat characteristic value and a fixing temperature correction value for each heat characteristic class. As shown in FIG. 6, the heat characteristic master table is data in tabular form in which 4 data items are associated with each other. The heat characteristic master table associates the "heat characteristic class", the glass transition temperature "Tg", the melting temperature "Tm", and the "fixing temperature correction value".

The "Tg" stores information representing the range of the value of the glass transition temperature Tg. The "Tm" stores information representing the range of the values of the melting temperature Tm in advance. The units of the values stored at "Tg" and "Tm" are both ° C. In the "heat characteristic class", a division name for uniquely identifying a combination of information stored in "Tg" and information stored in "Tm" is stored in advance.

The first heat characteristic number class is a heat characteristic class when the value of the glass transition temperature Tg is in the range of, for example, 30-34° C., and the value of the melting temperature Tm is in the range of, for example, 100-105° C. The second heat characteristic number class is a heat characteristic class when the value of the glass transition temperature Tg is in the range of, for example, 30-34° C., and the value of the melting temperature Tm is in the range of, for example, 106-109° C. The third heat characteristic number class is a heat characteristic class when the value of the glass transition temperature Tg is in the range of, for example, 35-40° C., and the value of the melting temperature Tm is in the range of, for example, 100-105° C. The fourth heat characteristic number class is a heat characteristic class when the value of the glass transition temperature Tg is in the range of, for example, 35-40° C., and the value of the melting temperature Tm is in the range of, for example, 106-109° C. The fifth heat characteristic number class is a heat characteristic class when the value of the glass transition temperature Tg is in the range of, for example, 35-40° C., and the value of the melting temperature Tm is in the range of, for example, 110-115° C. The sixth heat characteristic number class is a heat characteristic class when the value of the glass transition temperature Tg is in the range of, for example, 41-45° C., and the value of the melting temperature Tm is in the range of, for example, 106-109° C. The seventh heat characteristic number class is a heat characteristic class when the value of the glass transition temperature Tg is in the range of, for example, 41-45° C., and the value of the melting temperature Tm is in the range of, for example, 110-115° C. The number of heat characteristic classes is not limited to the 7 sections described above and may be increased or decreased as necessary.

A fixing temperature correction value corresponding to each heat characteristic class stored in the "heat characteristic class" is stored in advance in the "fixing temperature correction value". The unit of the value stored in the "fixing temperature correction value" is ° C.

The image forming apparatus 100 refers to the heat characteristic master table illustrated in FIG. 6. Thus, the image forming apparatus 100 recognizes, for example, that the value of the glass transition temperature Tg at the time of manufacturing is 31° C. and that the value of the melting temperature Tm at the time of manufacturing is 103° C. belongs to the first heat characteristic class. In this case, the image forming apparatus 100 corrects the fixing temperature at the time of fixing the developer belonging to the first heat characteristic class to the sheet from a predetermined fixing temperature by −10° C.

FIG. 7 is a diagram showing the arrangement of the information of the elapsed days master table in the memory 170 of the image forming apparatus 100 according to one embodiment. The elapsed days master table is a table indicating the elapsed days class determined according to the number of days after manufacturing the developer and the fixing temperature correction value for each of the elapsed days. As shown in FIG. 7, the elapsed days master table is data in tabular form in which three data items are associated with each other. The elapsed days master table associates the "elapsed days", the "elapsed days after manufacturing", and the "fixing temperature correction values".

The "elapsed days after manufacturing" stores information indicating the range of manufacturing days after manufacture of developer. The unit of the value stored in the "elapsed days after manufacturing" is [day]. In the "elapsed days class", a class name for uniquely identifying the information stored in the "number of days after manufacturing" is stored in advance.

The first elapsed days class is a lapsed days class when the elapsed number of days is in the range of 0-180 [days], for example. The second elapsed days class is a lapsed days class when the elapsed number of days is in the range of 181-300 [days], for example. The third elapsed days class is a lapsed days class when the elapsed days are 301 days or more, for example. Note that the number of lapsed days classes is not limited to 3 and may be increased or decreased as necessary.

In the "fixing temperature correction value", fixing temperature correction values respectively corresponding to the elapsed days of the elapsed days stored in the "elapsed days classification" are stored in advance. The unit of the value stored in the "fixing temperature correction value" is ° C.

The image forming apparatus 100 refers to the elapsed days master table illustrated in FIG. 7. Thus, the image forming apparatus 100 recognizes, for example, that the developer whose elapsed days after manufacturing are 255 days belongs to the second elapsed days class. In this case, the image forming apparatus 100 corrects the fixing temperature correction value at the time of fixing the developer belonging to the second elapsed date section to the sheet from a predetermined fixing temperature by +3° C.

Figure 8:
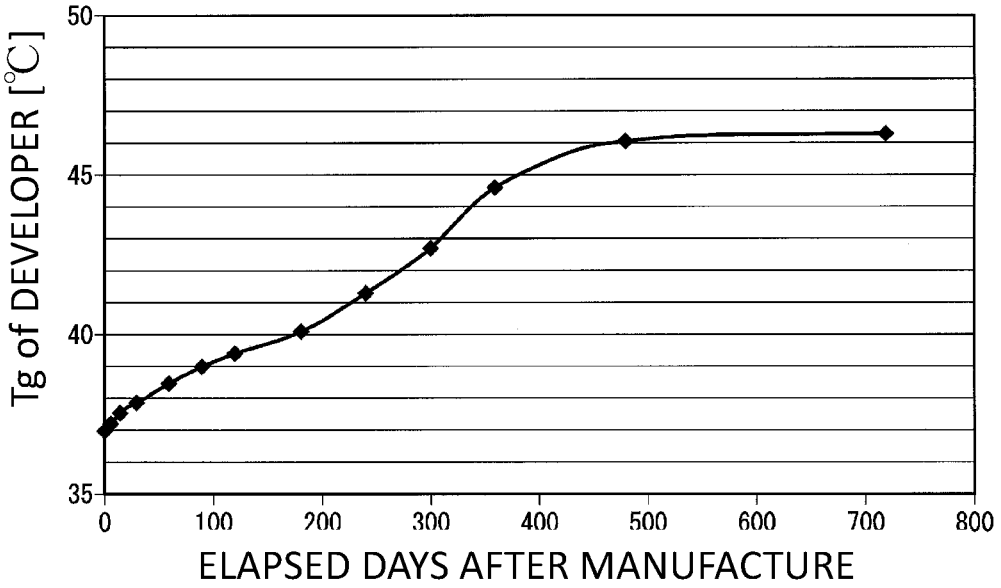
FIG. 8 is a diagram illustrating an example of a change in the glass transition temperature of developer.

FIG. 8 is a diagram illustrating an example of a change in the glass transition temperature of a developer. The horizontal axis represents the number of elapsed days from the manufacture date of a certain one developer. The vertical axis represents the glass transition temperature "Tg" of the developer. As shown in FIG. 8, the glass transition temperature of the developer is about 3° C. higher than that at the time of manufacturing when 180 days have elapsed from the manufacture date of developer. Also, the glass transition temperature of this developer rises by about 6° C. from the manufacture time when 300 days elapses from the manufacture date of the developer. Also, the glass transition temperature of this developer rises by about 9° C. from the manufacture time when 480 days elapses from the manufacture date of developer. Further, when 480 days or more has elapsed from the manufacture date of the developer, the heat characteristic of the developer is stable, and the glass transition temperature does not rise much thereafter.

The fixing temperature correction values respectively associated with the elapsed days of the elapsed days of the elapsed days master table shown in FIG. 7 are set based on the change in the glass transition temperature of the developer shown in FIG. 8. For example, the fixing temperature correction value is associated with the first elapsed date section based on the fact that the glass transition temperature of the developer rises by about 3° C. at the time point when 180 days has elapsed from the manufacture date.

As shown in FIG. 7, "0° C." is associated with a fixing temperature correction value as a first elapsed date section. For example, a fixing temperature correction value is associated with the second elapsed date section based on the fact that the glass transition temperature of the developer rises by about 6° C. at the time point when 300 days has elapsed from the manufacture date. As shown in FIG. 7, "+3° C." is associated as a fixing temperature correction value in the second elapsed date section. For example, a fixing temperature correction value is associated with the third elapsed date section based on the fact that the glass transition temperature of the developer rises by about 9° C. at the time point when 480 days has elapsed from the manufacture date. As shown in FIG. 7, "+5° C." is associated as a fixing temperature correction value in the third elapsed date section.

The range of the elapsed days in the elapsed days master table shown in FIG. 7 is defined based on the characteristics of changes in glass transition temperature of a developer as shown in FIG. 8. The change in the glass transition temperature of the developer shown in FIG. 8 is an example. Thermal properties such as changes in glass transition temperature may vary depending on, for example, the type of developer used. Therefore, it is preferable that the value of the range of the number of elapsed days in the elapsed days master table is appropriately defined in accordance with the heat characteristics of the respective developers.

The controller 160 derives the elapsed time (the number of elapsed days) from the manufacture date of the developer based on the manufacture date stored in the memory 170 and the time information generated by the timer 180. The controller 160 may update the derived elapsed time information at a predetermined period. The controller 160 selects a fixing temperature correction value, depending on the number of elapsed days from the manufacture date of developer.

When the number of elapsed days belong to the first elapsed days class, the controller 160 selects the fixing temperature correction value "0° C." associated with the first elapsed days class. When the number of elapsed days belong to the second elapsed days class, the controller 160 selects the fixing temperature correction value "+3° C." associated with the second elapsed days class. When the number of elapsed days belong to the third elapsed days class, the controller 160 selects the fixing temperature correction value "+5° C." associated with the third elapsed days class.

The controller 160 adds the fixing temperature correction value selected in response to the heat characteristic class and the fixing temperature correction value selected in accordance with the elapsed number of days. Then, the controller 160 adds the sum of the fixing temperature correction values to the predetermined fixing temperature. The fixing temperature correction value to be added may be determined based on a combination of a fixing temperature correction value corresponding to the heat characteristic class and a fixing temperature correction value corresponding to the elapsed number of days.

Next, an operation example of the image forming apparatus 100 will be described.

Figure 9:
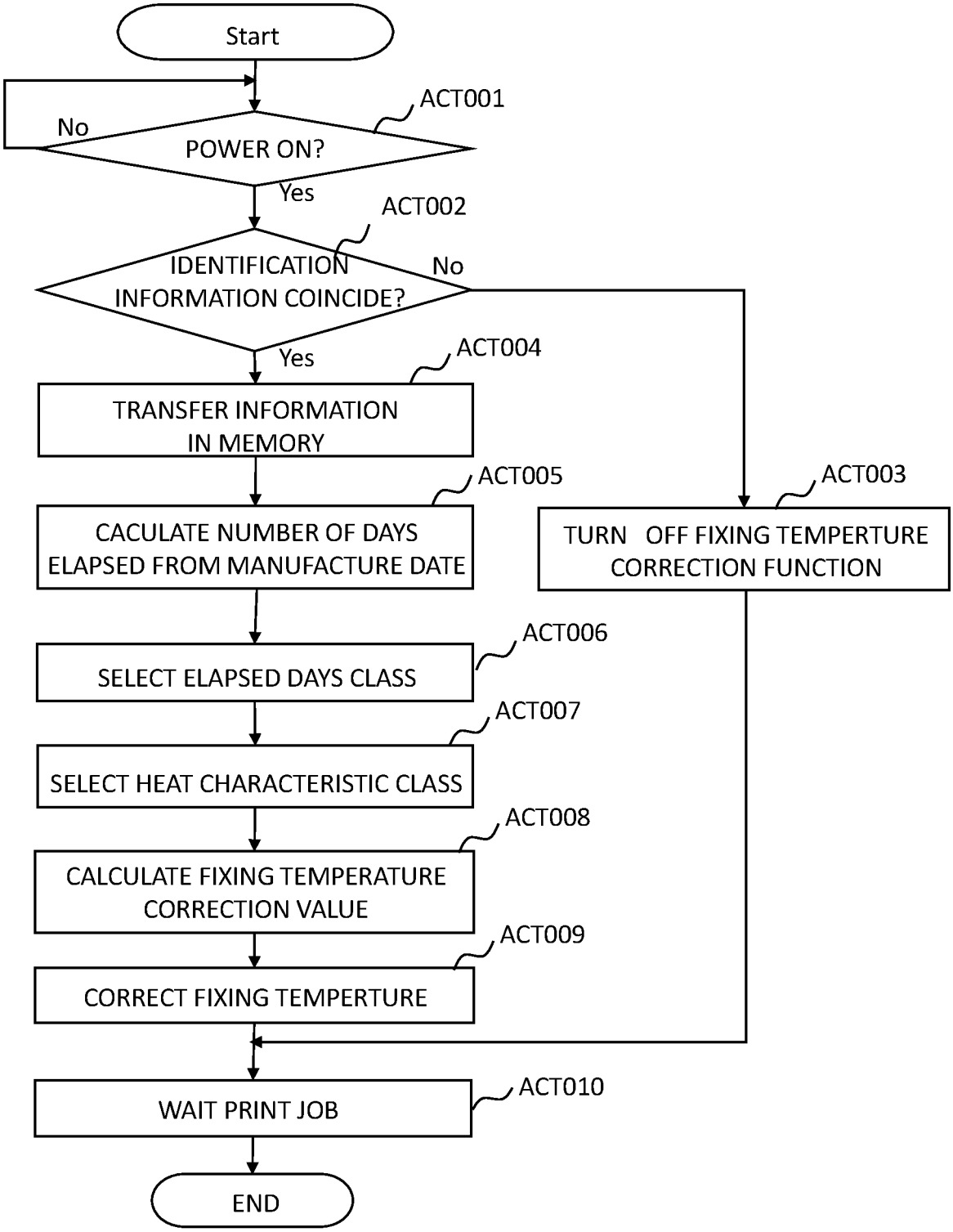
FIG. 9 is a flowchart illustrating an operation of the image forming apparatus according to one embodiment.

FIG. 9 is a flowchart illustrating an operation of the image forming apparatus 100 according to one embodiment.

When detecting that the power of the image forming apparatus 100 is turned on (ACT 001, Yes), the interface 150 collates the identification information in accordance with the control by the controller 160. The verification of the identification information is a collation between the identification information stored in the memory 170 and the identification information stored in the memory 301 of the cartridge 300. That is, the controller 160 determines whether or not the identification information of the address "A001" of the memory 170 coincides with the identification information of the address "B001" of the memory 301.

Note that the interface 150 may check identification information when it is detected that the front cover of the image forming apparatus 100 is opened or closed. Alternatively, the interface 150 may collate the identification information when the image forming apparatus 100 detects that the image forming apparatus 100 has reached the warm-up start state due to the return from the sleep state.

When the identification information does not coincide with each other (ACT 002, No), the controller 160 turns off the fixing temperature correction function (ACT 003). The case where the identification information does not match is a case where the identification information stored in the memory 170 does not coincide with the identification information stored in the memory 301.

When the identification information coincides with each other (ACT 002, Yes), the interface 150 transfers the manufacture date and the heat characteristic value stored in the memory 301 to the memory 170 (ACT 004). The case where the identification information matches is a case where the identification information stored in the memory 170 coincides with the identification information stored in the memory 301. The interface 150 performs the above transfer in accordance with the control by the controller 160.

The controller 160 acquires the current time information (calendar information) from the timer 180. The controller 160 calculates the number of elapsed days from the manufacture date of developer based on the current time information and the manufacture date stored in the memory 170 (ACT 005).

The controller 160 compares the calculated elapsed days with the elapsed days master table stored in the memory 170 and selects the elapsed days class (ACT 006). The controller 160 compares the heat characteristic value stored in the memory 170 with the heat characteristic master table stored in the memory 170 and selects a heat characteristic class (ACT 007).

The controller 160 adds the fixing temperature correction value corresponding to the selected elapsed number of days and the fixing temperature correction value corresponding to the selected heat characteristic class. As a result, the controller 160 calculates the fixing temperature correction value (ACT 008). The controller 160 reads a predetermined fixing temperature (fixing temperature before correction) stored in the memory 170. Then, the controller 160 corrects the fixing temperature so that the fixing temperature is equal to the temperature obtained by adding the calculated fixing temperature correction value to the predetermined fixing temperature (ACT 009).

The controller 160 performs setting so that fixing processing is performed by the fixing unit 50 at the corrected fixing temperature. Then, the controller 160 shifts the image forming apparatus 100 to the standby state of the print job (ACT 010).

Thus, the operation of the image forming apparatus 100 shown in the flowchart of FIG. 9 is completed.

As described above, the image forming apparatus 100 described above includes the fixing unit 50 and the controller 160 (temperature controller). The fixing unit 50 applies heat to the sheet at a predetermined fixing temperature. Thereby, the fixing unit 50 performs the fixing process of developer transferred to the sheet. The controller 160 corrects the fixing temperature in the fixing process based on the information indicating the manufacturing time of the developer.

With the configuration described above, the image forming apparatus 100 can appropriately set the fixing temperature for each developer in consideration of the change over time in the heat characteristic (for example, the value of the glass transition temperature Tg) of the developer. Therefore, the image forming apparatus 100 can have a margin in the fixing offset margin regardless of the change over time in the heat characteristic of the developer. Thus, the image forming apparatus 100 can reduce the occurrence of the fixing offset.

By providing the above configuration, the image forming apparatus 100 can reduce the occurrence of the fixing offset even if the heat characteristic is apt to change with time. As a toner whose heat characteristics are liable to change with time, there is a low-temperature fixing toner using, for example, a crystalline polyester resin in which the value of Tg tends to increase with the lapse of time. In this case, the image forming apparatus 100 can fix toner at a lower temperature than before while reducing the occurrence of a fixing offset. In this way, the image forming apparatus 100 can realize energy saving.

Hereinafter, a specific example will be described.

First, a method for measuring a glass transition temperature Tg will be described. For the measurement of the glass transition temperature Tg, a Thermogravibalance "Thermo Plus 2" manufactured by Rigaku Co., Ltd. was used. The amount of the toner to be used as a sample was 20 mg. Aluminum oxide (alumina) was used as a reference material. The temperature rise rate was set at 10° C. per minute. The measured temperature was set to be in the range of 0-120° C., and the result obtained by heating to 120° C. was used as the data. Then, a tangent line between the low temperature side and the high temperature side of the curve generated around 25-50° C. was drawn, and the value of the intersection point on the extended line was taken as the glass transition temperature Tg.

Next, a method of measuring a melting temperature Tm will be described. For the measurement of the melting temperature Tm, a constant force extruded type capillary rheometer "CFT-500 d" manufactured by Shimadzu Corporation was used. Then, the temperature value obtained by the temperature raising method (1/2 method) is defined as the melting temperature Tm. According to this method, the toner is placed in the constant force extruded type capillary rheometer and thereafter the temperature is raised at a constant rate while a constant load is applied to the toner. The value of the melting temperature Tm is the midpoint between the temperature at which the toner starts to melt and the temperature at which all of the toner has melted. The amount of the toner to be used as a sample was 1.5 g. The starting temperature was set to 30° C. The temperature reached was 180° C. The temperature rise rate was set at 2.5° C. per minute. The load was set to 10 kgf/cm 2. The preheating time was set to 300 seconds. Further, the die hole diameter and length were 1 mm.

Next, the fixing evaluation method will be described. For fixing evaluation, MFP "e-studio 5008 a" manufactured by Toshiba Tec Co., Ltd. was used. The rated voltage was 100 v. Fixing evaluation was carried out in two test environments, room temperature 10° C. and humidity 20% as a first test environment, and room temperature 35° C. and humidity 85% as a second test environment. In addition, in the first test environment of room temperature 10° C. and humidity 20%, a sheet having a paper basis weight of 60 g/m2 was used, and the rated voltage was set to 90 v. In addition, in the second test environment of 35° C. and 85% humidity, a sheet having a basis weight of 105 g/m2 was used, and the rated voltage was set to 110 v.

Figure 10:
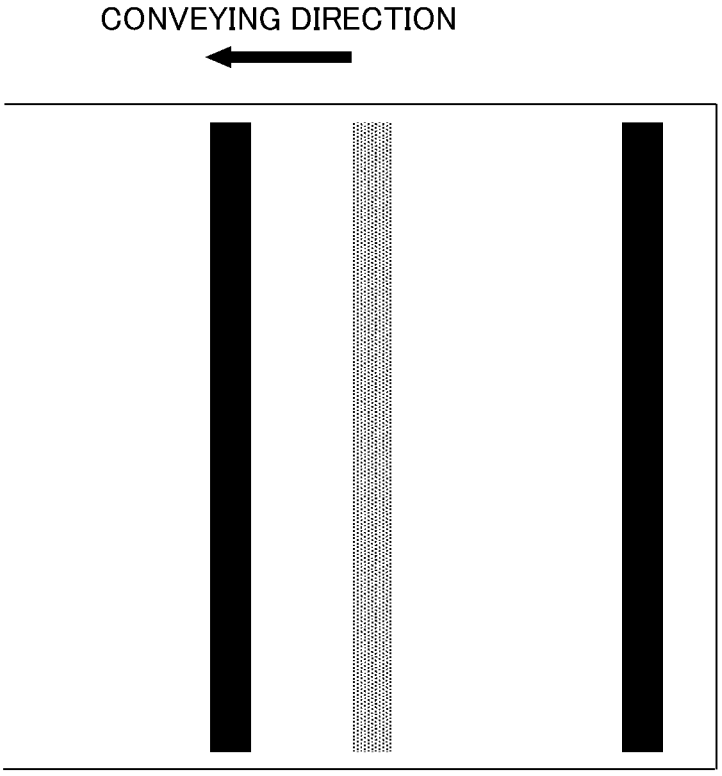
FIG. 10 is a schematic diagram showing an example of the occurrence of an offset.

The method for confirming the offset is as follows. A solid strip image having an image density of 1.3-1.4 was continuously fed with 100 sheets of A4 size sheets, and the sheets were repeatedly confirmed 10 times. As a result, the presence or absence of offset was determined by visually confirming whether or not the offset of the solid band image as shown in FIG. 10 was generated in the white background portion.

FIG. 11 is a diagram showing an evaluation result obtained by the above fixing evaluation. In FIG. 11, the "EXAMPLE" indicates a case where the fixing temperature correction according to the embodiment described above is performed. In addition, in FIG. 11, the "COMPARISON" indicates a case where the fixing temperature correction according to the embodiment described above is not performed for comparison with the EXAMPLE. As shown in FIG. 11, fixing evaluation was carried out for 13 examples and 12 comparative examples.

The heat characteristic class, the elapsed days and the fixing temperature correction function in the 13 examples and the fixing temperature correction value are shown in FIG. 11 in these 13 examples and in the 12 comparative examples. FIG. 11 shows the results of the determination of the presence or absence of offset in the first test environment of room temperature 10° C. and humidity 20% (%) for each of the examples and comparative examples. FIG. 11 shows the results of determination in the second test environment of room temperature 35° C. and humidity 85% for each of the examples and comparative examples.

In the item "determination", only when it is determined that no offset is generated in any of the test environments, the determination is set to "OK", and otherwise, the determination is set to "NG".

In the evaluation results described above, when the fixing temperature correction according to the embodiment described above was performed, even if the heat characteristics of the toner were changed, the offset was not observed. As described above, a change in heat characteristics is caused by, for example, a heat characteristic being fluctuated or a change over time being caused. On the other hand, when the fixing temperature correction according to the above-described embodiment was not performed, the occurrence of offset was confirmed by the test environment.

As shown in FIG. 11, in all of Examples 1-13 where the fixing temperature correction was carried out, the result of the determination was "OK". On the other hand, in all of the Comparative Examples 1-12 in which the fixing temperature correction was not performed, the result of the determination was "NG".

In the heat characteristic master table shown in FIG. 6, the specific values of the glass transition temperature Tg and the melting temperature Tm for each heat characteristic class are shown. Similarly, in the elapsed days master table shown in FIG. 7, a numerical value of the number of elapsed days from a specific manufacture date for each heat characteristic class is shown. However, these specific values are actually different depending on the type of developer, the type of image forming apparatus, and the like. Therefore, the ranges of the numerical values corresponding to the respective sections are not limited to the ranges shown in FIGS. 6 and 7.

In the fixing unit 50 described above, a method of fixing a toner image to a sheet by heating through a film-like member may be applied.

While certain embodiments have been described, these embodiments have been presented by way of example only and are not intended to limit the scope of the inventions. Indeed, the novel embodiments described herein may be embodied in a variety of other forms, furthermore, various omissions, substitutions and changes in the form of the embodiments described herein may be made without departing from the spirit of the inventions. The embodiments and variations thereof are included within the scope and spirit of the invention and are included within the scope of the appended claims and their equivalents.

What is claimed:

1. An image forming apparatus comprising:

a fixing unit configured to apply heat to a sheet at a predetermined fixing temperature to perform fixing processing of developer transferred to the sheet, and a temperature controller configured to correct the predetermined fixing temperature in the fixing process based on first information indicating a manufacturing time of the developer, and also based on an amount of time elapsed since the manufacturing time of the developer.

2. The image forming apparatus according to claim 1, further comprising:

a developer container configured to be attached to and detached from the image forming apparatus, the developer container including a first storage medium configured to store the first information of the developer.

3. The image forming apparatus according to claim 2, wherein the temperature controller is further configured to correct the predetermined fixing temperature based on second information representing heat characteristics of developer stored in the developer container, and the first storage medium is further configured to store the second information.

4. The image forming apparatus according to claim 3, wherein the second information is at least one of a glass transition temperature and a melting temperature at the time of manufacturing the developer.

5. The image forming apparatus according to claim 4, wherein the temperature controller is configured to store the first information and the second information in a second storage medium in the image forming apparatus.

6. The image forming apparatus according to claim 5, wherein the temperature controller is configured to determine from the first information the amount of time elapsed since the manufacturing time of the developer in the developer container and to determine an elapsed time fixing temperature correction value from the amount of time elapsed.

7. The image forming apparatus according to claim 6, wherein the second storage medium is configured to store a table comprising a plurality of heat characteristic classes, each heat characteristic class comprising a first range of glass transition temperatures and a second range of melting temperatures, the table further comprising a heat characteristic fixing temperature correction value for each heat characteristic class, the temperature controller being configured to determine a heat characteristic class from the second information and to determine the heat characteristic fixing temperature correction value for the determined heat characteristic class.

8. The image forming apparatus according to claim 7, wherein the temperature controller is configured to add the elapsed time fixing temperature correction value and the heat characteristic fixing temperature correction value for the determined heat characteristic class and correct the predetermined fixing temperature by adding a sum of the elapsed time fixing temperature correction value and the heat characteristic fixing temperature correction value for the determined heat characteristic class to the predetermined fixing temperature.

9. A developer container comprising:

a storage medium configured to store first information indicating a manufacturing time of developer contained in the developer container and second information representing at least one heat characteristic value of the developer stored in the developer container.

10. The developer container according to claim 9, wherein the at least one heat characteristic value comprises at least one of a glass transition temperature or a melting temperature of the developer in the developer container.

11. The developer container according to claim 10, wherein the at least one heat characteristic value is a heat characteristic value at a time of manufacturing the developer in the developer container.

12. A method of operating an image forming apparatus, comprising:

determining an elapsed time since a time of manufacturing of developer to be fixed to a sheet at a predetermined fixing temperature; and correcting the predetermined fixing temperature by adding an elapsed time fixing temperature correction value to the predetermined fixing temperature.

13. The method according to claim 12, further comprising:

determining at least one heat characteristic value of the developer, the at least one heat characteristic value being at least one of a glass transition temperature or a melting temperature at the time of manufacturing; and adding a heat characteristic fixing temperature correction value to the elapsed time fixing temperature correction value prior to correcting the predetermined fixing temperature.

14. The method according to claim 13, further comprising:

determining whether first identification information of a developer container that contains the developer coincides with second identification information of the developer container stored in the image forming apparatus.

15. The method according to claim 14, wherein whether the first identification information coincides with the second identification information is determined when the image forming apparatus is turned on.

16. The method according to claim 14, wherein whether the first identification information coincides with the second identification information is determined when a front cover of the image forming apparatus is opened or closed.

17. The method according to claim 14, wherein whether the first identification information coincides with the second identification information is determined when the image forming apparatus reaches a warm-up state from a sleep state.

18. The method according to claim 14, wherein the predetermined fixing temperature is not corrected when the first identification information and the second identification information do not coincide.

19. The method according to claim 12, further comprising:

fixing the developer to the sheet to form an image on the sheet.

* * * * *